US005727893A

United States Patent [19]

Handler

[11] Patent Number: 5,727,893

[45] Date of Patent: Mar. 17, 1998

[54] FLUID DISPENSING NIB, AND DELIVERY SYSTEM

[75] Inventor: Michael D. Handler, Danbury, Conn.

[73] Assignee: Binney & Smith Inc., Easton, Pa.

[21] Appl. No.: 426,681

[22] Filed: Apr. 21, 1995

[51] Int. Cl.[6] ..... B43K 1/02; B43K 1/04

[52] U.S. Cl. ..... 401/264; 401/262; 401/266

[58] Field of Search ..... 401/264, 262, 401/265, 266; 222/490, 494

[56] References Cited

U.S. PATENT DOCUMENTS

| | | | |
|---|---|---|---|
| D. 286,546 | 11/1986 | Funahashi | D19/43 |
| D. 323,186 | 1/1992 | Clark et al. | D19/48 |
| D. 332,283 | 1/1993 | Voorhees | D19/51 |
| 336,945 | 3/1886 | Redington . | |
| 426,622 | 4/1890 | Madden . | |
| 449,233 | 3/1891 | Porter | 401/208 |
| 596,951 | 1/1898 | Wiehl | 401/198 |
| 933,938 | 9/1909 | Windle et al. | 401/264 |
| 1,254,701 | 1/1918 | Keplinger . | |
| 1,615,506 | 1/1927 | Felt . | |
| 1,714,965 | 5/1929 | Ullner . | |
| 1,839,817 | 1/1932 | Walker . | |
| 1,959,774 | 5/1934 | Walsh | 401/264 |
| 2,005,642 | 6/1935 | Thornton | 222/490 |
| 2,014,149 | 9/1935 | Stafford | 401/264 |
| 2,094,700 | 10/1937 | Gunn | 401/264 |
| 2,208,201 | 7/1940 | Smith | 222/490 |
| 2,291,859 | 8/1942 | Andrews | 120/49 |
| 2,370,414 | 2/1945 | Ostrander | 132/79 |
| 2,396,058 | 3/1946 | Rath | 120/43 |

(List continued on next page.)

FOREIGN PATENT DOCUMENTS

| | | | |
|---|---|---|---|
| 1119242 | 6/1956 | France | 401/264 |
| 2662145 | 11/1991 | France | 222/494 |
| 802559 | 2/1951 | Germany | 401/264 |
| 1276506 | 8/1968 | Germany . | |
| 2319942 | 10/1974 | Germany . | |
| 3615094A1 | 11/1987 | Germany . | |
| 331120 | 10/1935 | Italy . | |
| 1032863 | 6/1966 | United Kingdom . | |
| 1086310 | 10/1967 | United Kingdom . | |
| 1350320 | 4/1974 | United Kingdom . | |
| 2067475 | 7/1981 | United Kingdom . | |
| 2041834 | 7/1982 | United Kingdom . | |
| WO85/05344 | 12/1985 | WIPO . | |
| WO89/00925 | 2/1989 | WIPO . | |

OTHER PUBLICATIONS 4 pages of adverisement for Rolliter Rolling Highlighter by Inventure Development Corp., available in approximately Mar., 1992.

8 photographs (in assembled and disassembled states) of container and product entitled "Elmer's Mucilage" Borden Inc. ©1993.

Specification sheet entitled "Control flow applicators and coverings" Dab–O–Matic, Mount Vernon, New York, available in approximately Jun., 1994.

6 pages of advertisement by Flocon, Inc., Barrington, Illinois, available in approximately Jun., 1995.

5 pages of advetisement for VERNAY Duckbill Check Valves, VERNAY Laboratories, Inc. ©1992.

6 photographs (in assembled and disassembled states) of Second Nature Whisper check valve (duckbill aquarium valve) Willinger Bros. Inc., Oakland, New Jersey, purchased in a store in approximately Jun., 1994.

*Primary Examiner*—Steven A. Bratlie
*Attorney, Agent, or Firm*—Leydig, Voit & Mayer, Ltd.

[57] ABSTRACT

A nib for dispensing fluid comprising an elastomeric valve including a relatively rigid internal resistor. The nib is suitable for dispensing highly viscous fluids, such as paint, and for dispensing fluid containing particulate matter, such as glitter paint. Preferably, the nib includes a first sealing lip and a second sealing lip which meet to form a dispensing slit. Preferably, the nib has an exterior surface including first and second opposing faces, wherein each face includes an external resistor. The nib may also include one or more protrusions on the bottom of the nib. A instrument for dispensing fluid is also disclosed.

33 Claims, 7 Drawing Sheets

U.S. PATENT DOCUMENTS

| | | | |
|---|---|---|---|
| 2,416,596 | 2/1947 | Rosenthal | 15/134 |
| 2,453,201 | 11/1948 | Cushman | 15/135 |
| 2,546,709 | 3/1951 | Abarr | 222/490 X |
| 2,549,227 | 4/1951 | Ostrander | 15/134 |
| 2,624,901 | 1/1953 | Wiley | 401/264 |
| 2,713,176 | 7/1955 | Rosenthal | 15/134 |
| 2,762,072 | 9/1956 | Madalinski | 15/132.5 |
| 2,913,748 | 11/1959 | Felter | 401/264 |
| 3,003,181 | 10/1961 | Rosenthal | 15/563 |
| 3,003,182 | 10/1961 | Rosenthal | 15/563 |
| 3,050,768 | 8/1962 | Rosenthal | 15/563 |
| 3,089,182 | 5/1963 | Lofgren | 15/563 |
| 3,141,187 | 7/1964 | Simon, Jr. et al. | 15/563 |
| 3,203,025 | 8/1965 | Schreur | 15/563 |
| 3,221,360 | 12/1965 | Seeman | 15/537 |
| 3,355,239 | 11/1967 | Albrecht | 401/148 |
| 3,369,543 | 2/1968 | Ronco | 128/269 |
| 3,463,597 | 8/1969 | Wakai | 401/206 |
| 3,480,370 | 11/1969 | Koeln | 401/107 |
| 3,586,454 | 6/1971 | Funahashi | 401/198 |
| 3,614,247 | 10/1971 | Otsuka | 401/199 |
| 3,628,876 | 12/1971 | Casey | 401/198 |
| 3,659,953 | 5/1972 | Taylor | 401/198 |
| 3,684,389 | 8/1972 | Eron | 401/207 |
| 3,726,436 | 4/1973 | Despain et al. | 222/494 X |
| 3,896,196 | 7/1975 | Dickey et al. | 264/6 |
| 3,902,815 | 9/1975 | Williams | 401/264 |
| 3,942,903 | 3/1976 | Dickey et al. | 401/198 |
| 3,966,336 | 6/1976 | Lotfallah | 401/209 |
| 3,969,027 | 7/1976 | Randar et al. | 401/199 |
| 3,969,028 | 7/1976 | Negreiros | 401/279 |
| 4,037,976 | 7/1977 | McDaniel et al. | 401/193 |
| 4,043,682 | 8/1977 | McDaniel et al. | 401/199 |
| 4,076,427 | 2/1978 | Anderson | 401/6 |
| 4,201,491 | 5/1980 | Kohler | 401/264 |
| 4,229,115 | 10/1980 | Olinsky | 401/196 |
| 4,317,639 | 3/1982 | Kato | 401/209 |
| 4,410,290 | 10/1983 | Ito et al. | 401/198 |
| 4,469,464 | 9/1984 | Capezzuto | 401/183 |
| 4,500,222 | 2/1985 | Clading-Boel | 401/209 |
| 4,568,214 | 2/1986 | Abe et al. | 401/141 |
| 4,575,271 | 3/1986 | Hashimoto et al. | 401/107 |
| 4,583,875 | 4/1986 | Manusch et al. | 401/133 |
| 4,629,348 | 12/1986 | Hashimoto et al. | 401/107 |
| 4,640,637 | 2/1987 | Winthrop | 401/101 |
| 4,723,859 | 2/1988 | Kitoh | 401/199 |
| 4,761,232 | 8/1988 | Bright | 210/500.36 |
| 4,776,495 | 10/1988 | Vignot | 222/494 X |
| 4,783,185 | 11/1988 | Erismann et al. | 401/37 |
| 4,792,252 | 12/1988 | Kremer et al. | 401/206 |
| 4,813,463 | 3/1989 | Lin | 141/351 |
| 4,969,766 | 11/1990 | Nagle et al. | 401/202 |
| 4,993,858 | 2/1991 | Mock | 401/34 |
| 5,017,034 | 5/1991 | Stary et al. | 401/35 |
| 5,073,058 | 12/1991 | Fukuoka et al. | 401/260 |
| 5,218,956 | 6/1993 | Handler et al. | 128/66 |
| 5,222,823 | 6/1993 | Conforti | 401/202 |

FLUID DISPENSING NIB, AND DELIVERY SYSTEM

TECHNICAL FIELD OF THE INVENTION

The present invention is directed towards a nib for dispensing viscous fluids such as paint and ink, and for dispensing fluid compositions containing particulate matter, such as glitter. The present invention further is directed towards an instrument for dispensing such fluid compositions.

BACKGROUND OF THE INVENTION

Coloring fluids generally are mixtures of a coloring matter dispersed or dissolved in a carrier medium. Many forms of coloring fluids are available to allow children and adult artists to engage in activities such as coloring, painting, and drawing. For example, crayons, liquid paints, pan paints, markers, pens, and so forth long have been known. The coloring fluid may be highly viscous liquid. For example, the coloring fluid may be an acrylic paint. Coloring fluids also may contain particulate matter, such as large pigment particles or glitter.

Activities such as coloring and painting involve the transfer of the coloring fluid from a storage area, such as a fluid reservoir, onto a marking surface, such as a piece of paper. A number of systems are available to allow children and adult artists to transfer a coloring fluid to a marking surface. For example, marking instruments, brushes, finger painting bottles, and the like commonly are used by children and adult artists.

Among these systems, marking instruments have a number of advantages over other systems for delivering coloring fluids. For example, marking instruments allow a child or adult artist to dispense the coloring fluid contained within the marking instrument with precision. In addition, because marking instruments completely contain the coloring fluid within a fluid reservoir inside the marking instrument, the possibility of spilling the coloring fluid is minimize. Further, marking instruments usually may be provided with a cap, thus allowing the user to seal the fluid reservoir for storage or transportation of the marking instrument.

A marking instrument generally may be said to comprise a barrel, a fluid reservoir contained within the barrel for storing coloring fluid, and a nib for dispensing the coloring fluid onto a marking surface. Nibs for use in marking instruments include bonded random fiber nibs, bonded oriented fiber nibs, sintered plastic nibs, and extruded plastic nibs.

Most nibs are unsuitable for highly viscous fluids. Many paints have viscosities of 100 centipoise at room temperature, and there is a need for nibs to accommodate such fluids. In addition, as more varieties of coloring fluids with different physical properties are developed, nibs are needed to accommodate the variety of viscosities and other fluid properties associated with these coloring fluids.

Further, most nibs are unable to dispense coloring fluids containing glitter or other particulate matter. Many inks and paints are formulated using glitter and similar particulate matter, and there is a need for a nib suitable for dispensing such inks and paints. Moreover, coloring fluids containing large pigment particles will not readily be dispensed from many nibs. Also, some nibs may further suffer the disadvantages of the fluid hardening on the nib or clogging the nib when the nib has been left uncovered for a period of time.

Nibs including a plunger have been used to accommodate viscous fluids and fluids containing particulate matter. Examples of such plunger nibs are those illustrated in U.S. Pat. Nos. 4,792,252; 4,813,463; and 5,073,058. Such plunger nibs typically contain a pressure-activated spring-loaded plunger for dispensing fluid from the fluid reservoir. To dispense the fluid, a user presses the tip of the nib down onto the marking surface, thus allowing the fluid to be released from the fluid reservoir.

These plunger nibs may suffer from a number of drawbacks which render such nibs impractical for ordinary use. First, the need to press the tip of the nib onto the marking surface is an unnatural motion and is cumbersome for both children and adult artists. Second, such nibs readily may be opened inadvertently to allow an excess of coloring fluid to be dispensed. This situation is especially true when the user pauses while writing or marking. Third, such nibs are very expensive in relation to the other components of the marking instrument. Fourth, dried fluid that has been dispensed from these nibs accumulates on the nib, requiring periodic cleansing of the nibs.

Accordingly, there exists a need for a nib for dispensing fluids, such as coloring fluids, that do not suffer from these drawbacks. Ideally, the nib should allow a user to dispense a variety of fluids, including highly viscous fluids and fluids containing particulate matter with precision and control. Such a nib further should be inexpensive to manufacture. In addition, the nib should not be subject to product dryout when the nib inadvertently has been left uncovered. A need further exists for a marking instrument including such a nib.

These needs are not limited to the art of coloring fluids, and any application in which a highly viscous fluid or a fluid containing particulate matter must be dispensed from a fluid reservoir would benefit from such a nib. For example, instruments for dispensing adhesives, oils, lubricants or other viscous liquids may utilize such a nib. Other applications in which a such nib may be utilized include cosmetics, medical and industrial areas.

BRIEF SUMMARY OF THE INVENTION

The present invention overcomes the drawbacks of conventionally known nibs by providing a nib for dispensing a fluid composition, the nib comprising an elastomeric valve, and a separate or integral internal resistor for the valve. A nib according to the present invention is able to dispense a variety of fluids, including highly viscous coloring fluids, without difficulty. Moreover, the nib is able to dispense fluids containing particulate matter, such as coloring fluids containing glitter or large pigment particles.

DESCRIPTION OF THE PREFERRED EMBODIMENTS

Figure 1:
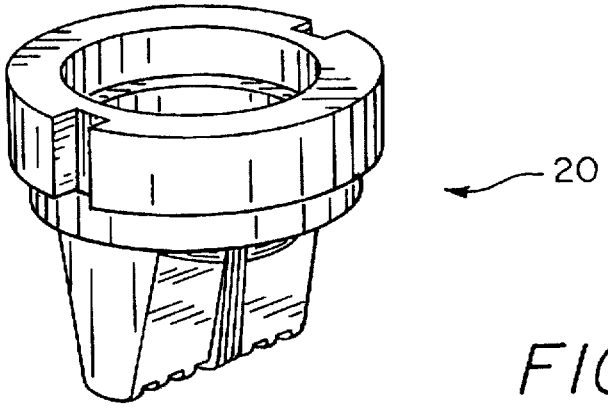
FIG. 1 is a left front perspective view of a nib according to the present invention.

A nib 20 according to the preferred embodiment of the present invention is illustrated in FIGS. 1–6. The nib 20 comprises a first elastomeric wall 22, a second elastomeric wall 24, and two sealing lips 42 and 44, which together form a valve body 26. The valve body is made of an elastomeric type material which can be processed and formed by conventional rubber compression molding, or molded of a thermoplastic elastomer in conventional thermoplastic processes such as injection molding. Typical materials include ethylene propylene, silicone, fluorsilicones, urethane, polyurethanes, styrenic based polymers and polyesther based thermal plastic elastomers. The preferred material is high molecular weight ethylene propylene diene monomer and is made by compression molding.

Figure 2:
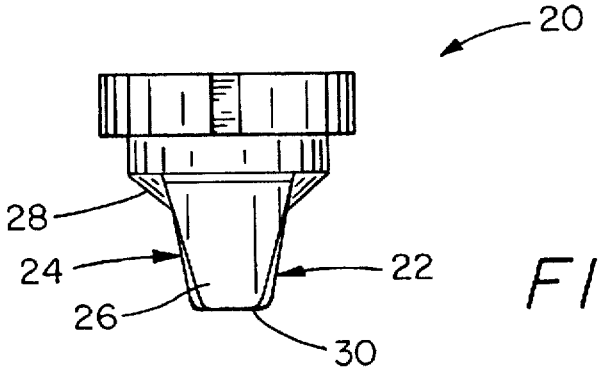
FIG. 2 is a left side elevational view of the nib illustrated in FIG. 1.
Figure 3:
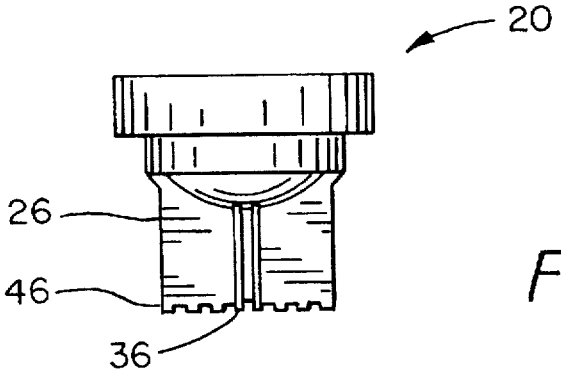
FIG. 3 is a front elevational view of the nib illustrated in FIG. 1.
Figure 5:
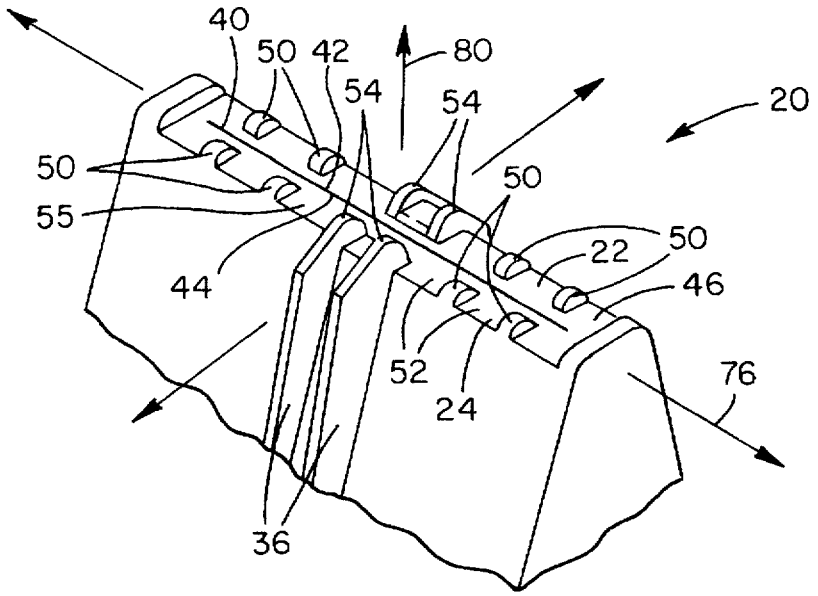
FIG. 5 is an enlarged bottom perspective view of the nib illustrated in FIG. 1.
Figure 6:
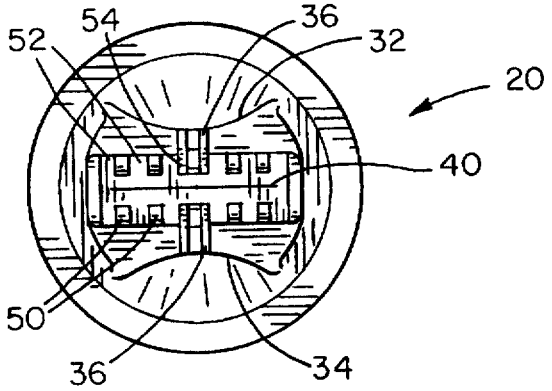
FIG. 6 is a bottom plan view of the nib illustrated in FIG. 1.

The valve body 26 terminates at the distal end 46 of the nib 20 at two lips 42, 44, which define a linear fluid dispensing slit 40, as shown in FIG. 5. Preferably, the slit 40 has a length of 0.195 inches. As shown in FIGS. 2 and 5, the nib 20 preferably has a top portion 28, a bottom portion 30, including sealing lips 42, 44, and the opposing walls 22, 24.

Each opposing wall 22, 24, includes an external resistor 36 on the external surface. The external resistor 36 may be integral with the wall or may be a separate component. Preferably, the external resistor is integral with the wall and is made of the same material, and formed simultaneously with the balance of the valve body. If the external resistor is a separate component, the external resistor could be made from plastic, metal or similar materials, and may be attached to the face by an adhesive or other means.

Figure 7:
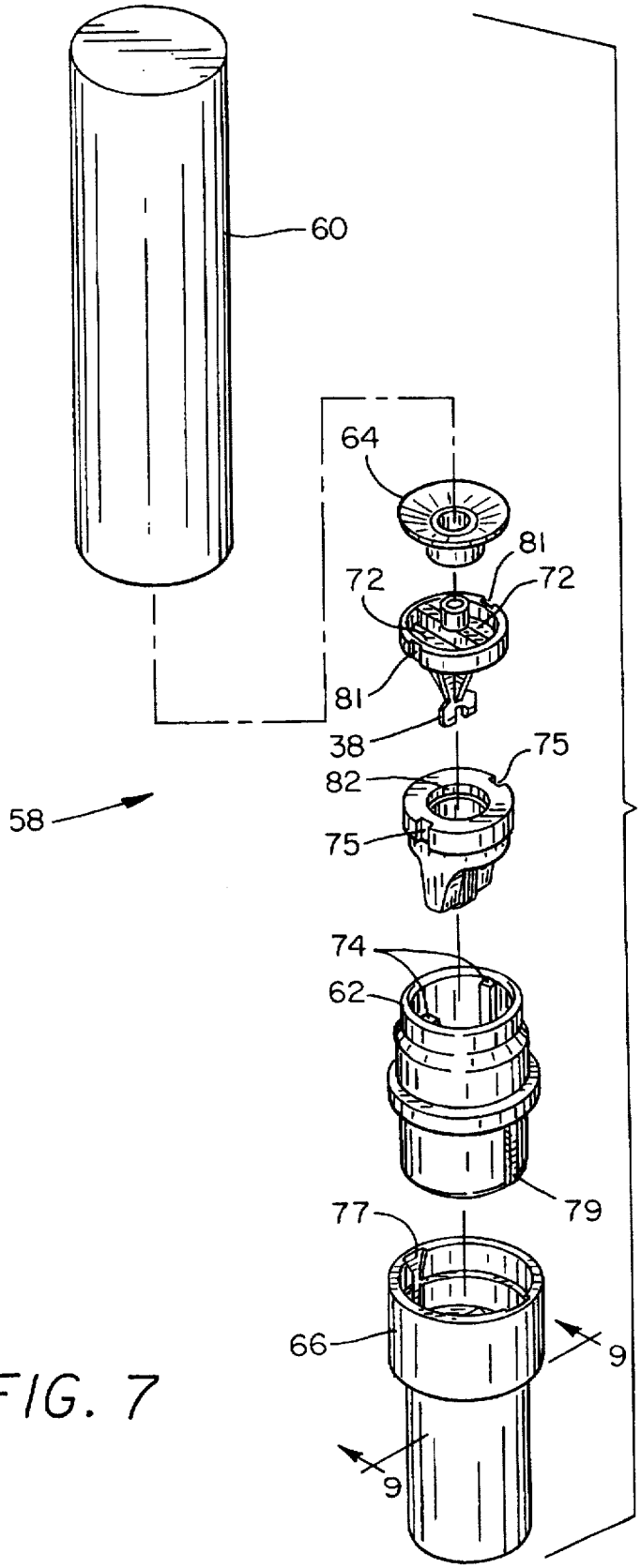
FIG. 7 is an exploded view of an instrument according to the present invention.
Figure 12:
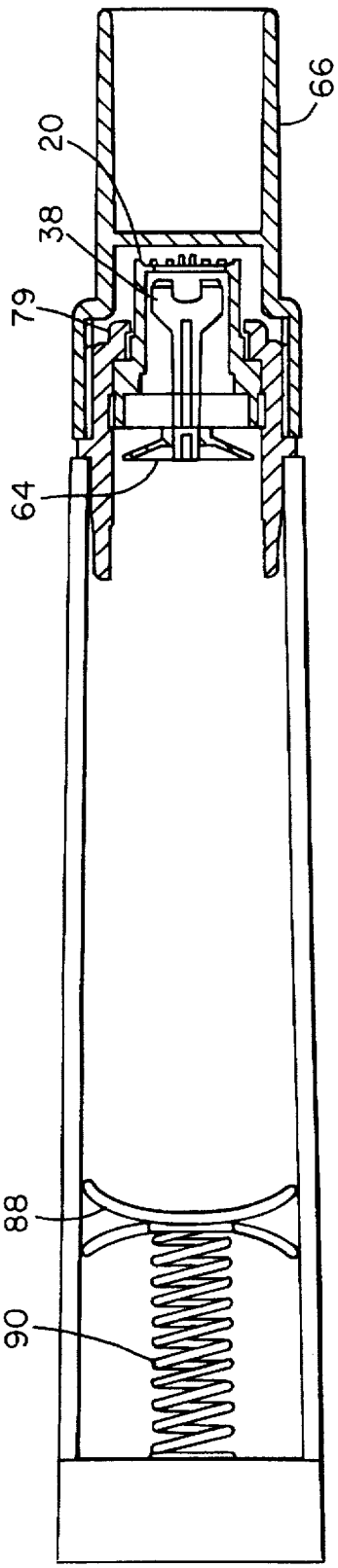
FIG. 12 is a cross-sectional view of a second alternative embodiment using a follower reservoir.

The nib 20 further includes an internal resistor 38 disposed between the first and second elastomeric walls 22, 24. The internal resistor 38 is relatively rigid with respect to the valve body 26. The internal resistance required for proper valve function may be executed separately as illustrated in FIG. 7 or may be formed integrally with the elastomeric nib walls 22, 24 as shown in FIG. 12. As illustrated in FIG. 7 of the preferred embodiment, the internal resistor 38 is a separate element that includes passages 72 for fluid flow. The internal resistor 38 may be made from plastic, metal, or the like. Typical materials might come from the olefin group. The preferred material is polypropylene.

Figure 4A:
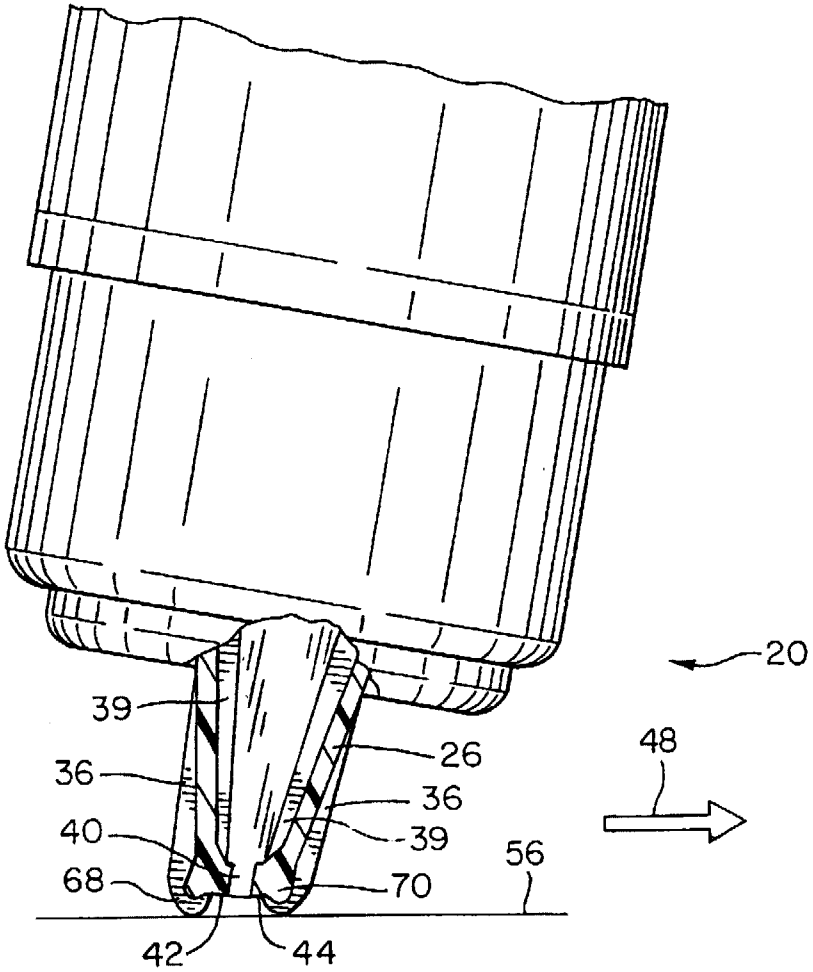
FIG. 4A is a partial cross-sectional view of an alternative embodiment of the nib assembled in an instrument and illustrating the operation of the nib.

As shown in FIG. 4A, the nib 20 may include internal resistors 39 disposed between or associated with the internal surface of the nib. The internal resistor 39 may be integral with the wall or may be a separate component. Preferably, the internal resistor is integral with the wall and is made of the same material, and formed simultaneously with the balance of the valve body. If the internal resistor is a separate component, the internal resistor could be made from plastic, metal or similar materials, and may be attached to the wall by an adhesive or other means. However, the internal resistor 39 need not necessarily be attached to the wall. The nib 20 may include one internal resistor 39, or one internal resistor 39 on each wall, or several internal resistors 39 on each wall. Furthermore, the internal resistors 39 may be used alone or in combination with internal resistor 38.

Figure 4:
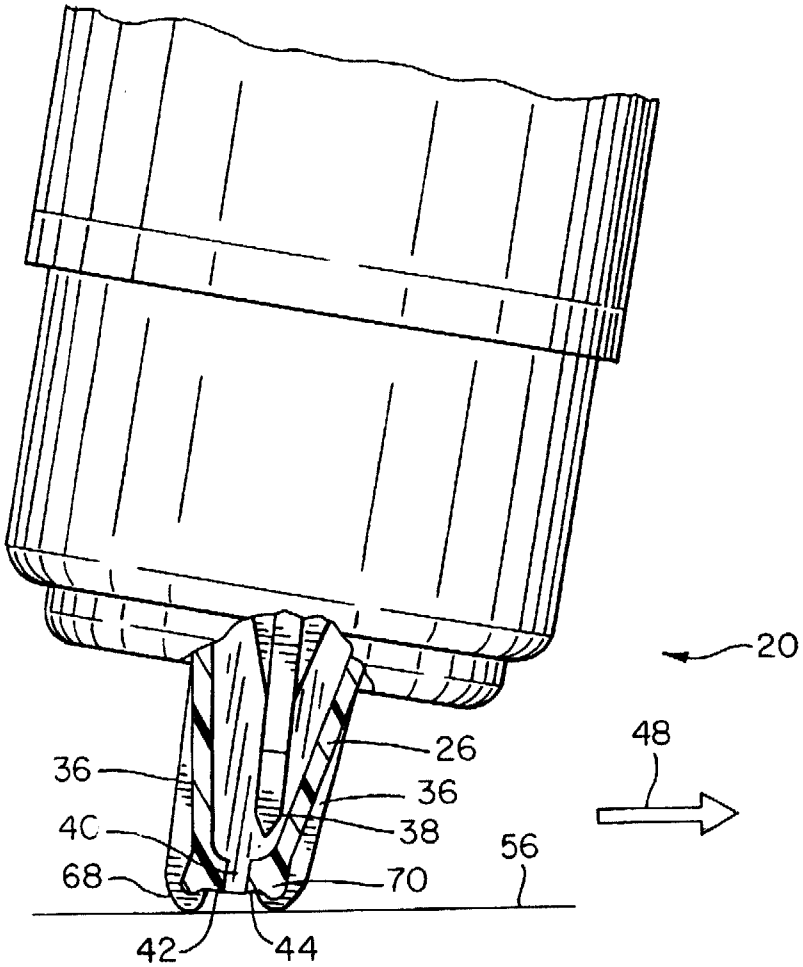
FIG. 4 is a partial cross-sectional view of the nib illustrated in FIG. 1 assembled in an instrument and illustrating the operation of the nib.

The function of the internal resistor 38, 39 and external resistors 36 is to allow the valve body 26 to retain its shape when the nib 20 is pulled over a surface. FIGS. 4 and 4A illustrate the nib 20 assembled into a complete instrument, including internal resistor 38, 39, as it is drawn across a surface 56. As the nib 20 is pulled along the broad line axis of the nib, illustrated by arrow 48 in FIGS. 4 and 4A, the slit 40 opens to allow fluid to be dispensed.

The internal resistor 38, 39 enhances the opening of the sealing lips 42, 44 by preventing the forward wall from collapsing, and thus prevents the valve body 26 from folding over onto itself.

The external resistor 36 prevents the trailing wall from folding or rolling over, and in effect closing off the nib and preventing the flow of fluid. Another one of the effects of the trailing wall folding or rolling over near the distal end would be to negate the operation of the protrusions and channels described below, and thus impacting on the characteristics of any flow that may occur. The external resistor on the trailing wall also plays an important role in the ability of the valve to open efficiently during use, in conjunction with central protrusions 54.

When the user pauses, and reduces the downward pressure of the marking instrument on the surface, lips 42, 44 immediately rejoin, thus closing the slit 40, and preventing inadvertent leakage of the fluid dispensed from the nib 20. Thus, the nib automatically closes when the nib is not in use.

As illustrated in FIG. 5, the distal end 46 of the nib includes one or more protrusions 50. These protrusions are shaped and sized in order to provide optimum standoff from the surface to be marked 56, and optimum channels 52 between protrusions, and relative to the formulation characteristics of the fluid to be dispensed, as well as the length of slit 40, in order to provide the most efficient and optimized dispensing capability. The central protrusions 54 preferably are larger than the other protrusions, thus enabling one of the central protrusions 54 to pull open the valve 26 when the nib 20 first contacts the surface.

Preferably, the protrusions 50 are parallel to the broad line axis of the nib 20. The protrusions 50 prevent the major surface 55 of the nib 20 from wiping away the fluid dispensed from the nib 20 or leaving a minimum and inconsistent application of fluid. Preferably, these protrusions form a plurality of channels 52 for the fluid to flow through after the fluid has been dispensed from the nib. The height of the protrusions 50 and the width of the channels 52 can be utilized to regulate the amount of fluid which is dispensed at a given speed of the nib pull.

Preferably, the height of the protrusions 50 is 0.010 inches and the width of the channels is 0.025 inches to achieve a fluid flow of 450–850 mg./100 feet. Preferably, the height of the central protrusions 54 is 0.020 inches which is 0.010 inches higher than the other protrusions 50.

The nib need not be drawn across a surface in the direction of the broad line axis, and, indeed, the nib may be drawn across the surface in any direction. For example, the nib may be drawn across a surface in the direction of the narrow line axis, shown by arrow 76 in FIG. 5. When the nib is drawn across the surface in this direction, the stiffness of the ends of the nib relative to the walls causes the valve 26 to open slightly, thus allowing fluid to be dispensed. The width of the line of fluid dispensed will be relatively narrow as compared to the width of the line of fluid dispensed when the nib 20 is drawn across the broad line axis. The width may be adjusted by varying the angle at which the nib is drawn across the surface. For example, the nib may be drawn across a surface in the direction illustrated by arrow 80 in FIG. 5, i.e. at an angle to both the broad line axis and the narrow line axis.

A line of fluid of intermediate width will thus be dispensed.

Figure 8:
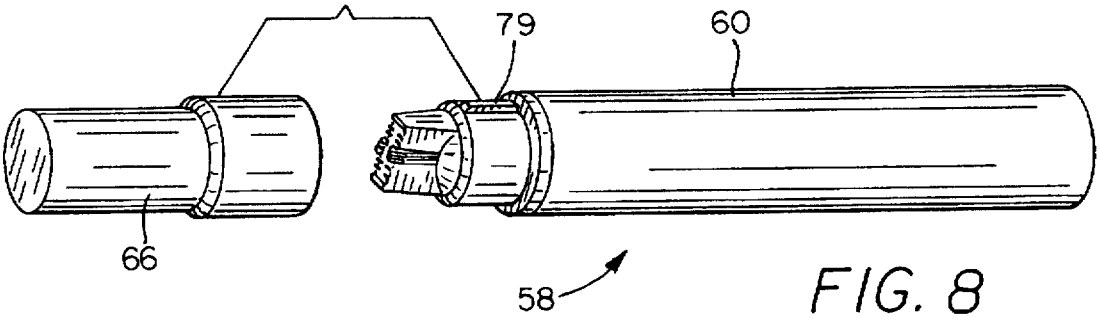
FIG. 8 is a perspective view of an instrument according to the present invention.

An instrument containing the nib 20 also falls within the purview of the present invention. Preferably, the instrument is a marking instrument for dispensing a coloring composition. As illustrated in FIGS. 7 and 8, an instrument 58 according to the present invention generally comprises a barrel 60, a fluid reservoir contained within the barrel 60, and a nib 20 fluidly connected to the fluid reservoir at the proximal end 82 of the nib. The nib 20 is secured to the barrel 60 by means of a collar 62, into which the nib is inserted and onto which the barrel 60 subsequently is secured. Alignment rails 74 may be included with the collar 62 to engage nib channels 75 and internal resistor channels 81. The instrument also may include a cap 66. The instrument may be constructed of any number of materials, including, for example, plastic, metal, wood, and so forth. When the instrument is a marking instrument, the barrel, collar and cap preferably are constructed of polypropylene by injection molding.

The fluid is contained within a fluid reservoir inside the barrel 60 of the instrument. Fluid reservoirs are well known to the art, and the selection of a particular fluid reservoir will depend upon the particular fluid to be contained within the instrument. For example, when the fluid is a viscous paint, the fluid reservoir may be a cavity within the barrel 60. When the fluid is an ink, the fluid reservoir may be an absorbent fibrous body within a cavity in the barrel that contacts the nib and effectuates a fluid connection between the nib and the cavity. Other fluid reservoirs may be employed such as, a squeezable reservoir shown in FIGS. 10–11, a follower reservoir shown in FIG. 12, a cartridge reservoir shown in FIG. 13, a bladder reservoir shown in FIG. 14 and a pressurized reservoir shown in FIG. 15.

Preferably, a hydraulic dampener 64 is inserted between the nib and the barrel 60. The dampener 64 will minimize the amount of fluid that will escape from the nib if the instrument is dropped and the cap is off of the instrument. The hydraulic dampener 64 preferably is an elastomeric disc that acts as a flapper valve for sealing the fluid connection between the fluid reservoir and the nib. In the normal position, the dampener 64 does not seal the fluid connection between the fluid reservoir and the nib. However, when the instrument is dropped, the dampener 64 covers the passages 72 to seal the fluid connection. The dampener is activated by the hydraulic pressure generated by the acceleration and impact when the instrument is dropped. Thus, the hydraulic dampener inhibits the fluid contained within the instrument from inadvertently escaping when the instrument is dropped onto a floor or table.

Figure 9:
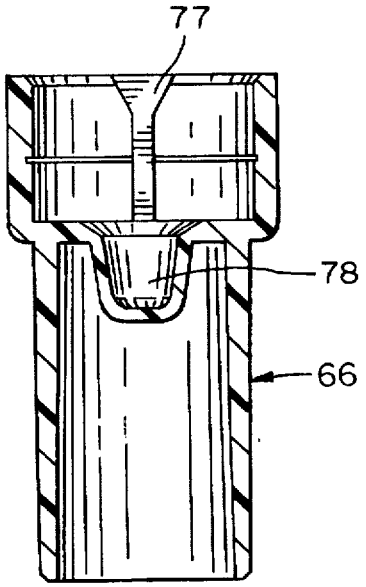
FIG. 9 is a cross sectional view of the cap of the instrument of the present invention taken along line 9—9 in FIG. 7.

The cap 66 is illustrated in FIGS. 7–9. Preferably, a portion 78 the cap mimics the shape of the nib. The inner portion 78 exerts a slight pressure on the nib when the cap is in place, thus supporting the sealing of the slit 40 and preventing the nib from inadvertently dispensing any fluid when the instrument is jarred. The cap 66 preferably includes a groove 77 to engage collar rib 79, thus aligning the cap 66.

Preferably, the instrument draws in air to replace the fluid dispensed from the instrument. This is accomplished via direct transfer through the nib, or via a one-way check valve incorporated in the instrument, including the collar or barrel.

Figure 10:
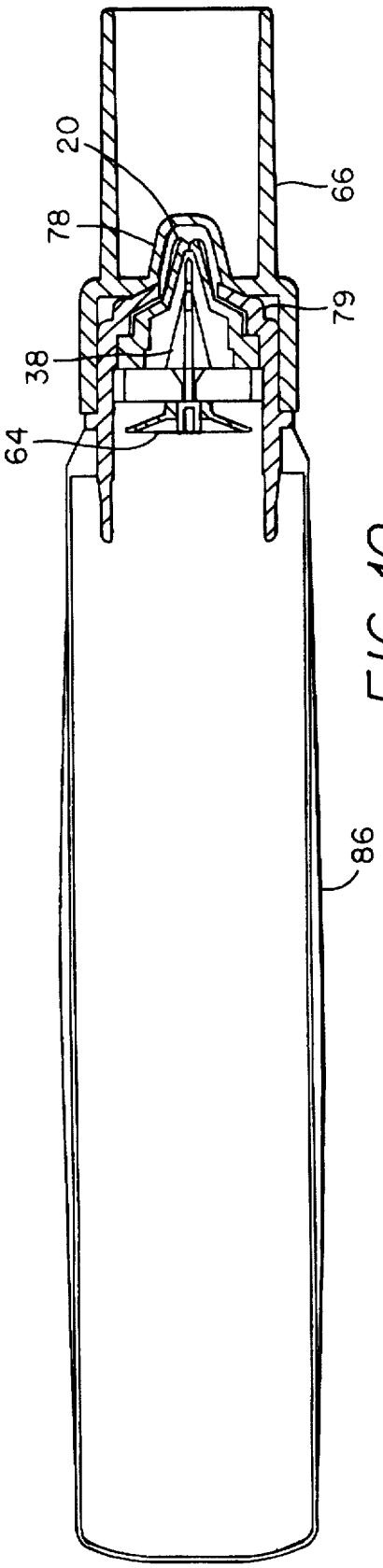
FIG. 10 is a cross-sectional view of a first alternative embodiment using a squeezable reservoir.
Figure 11:
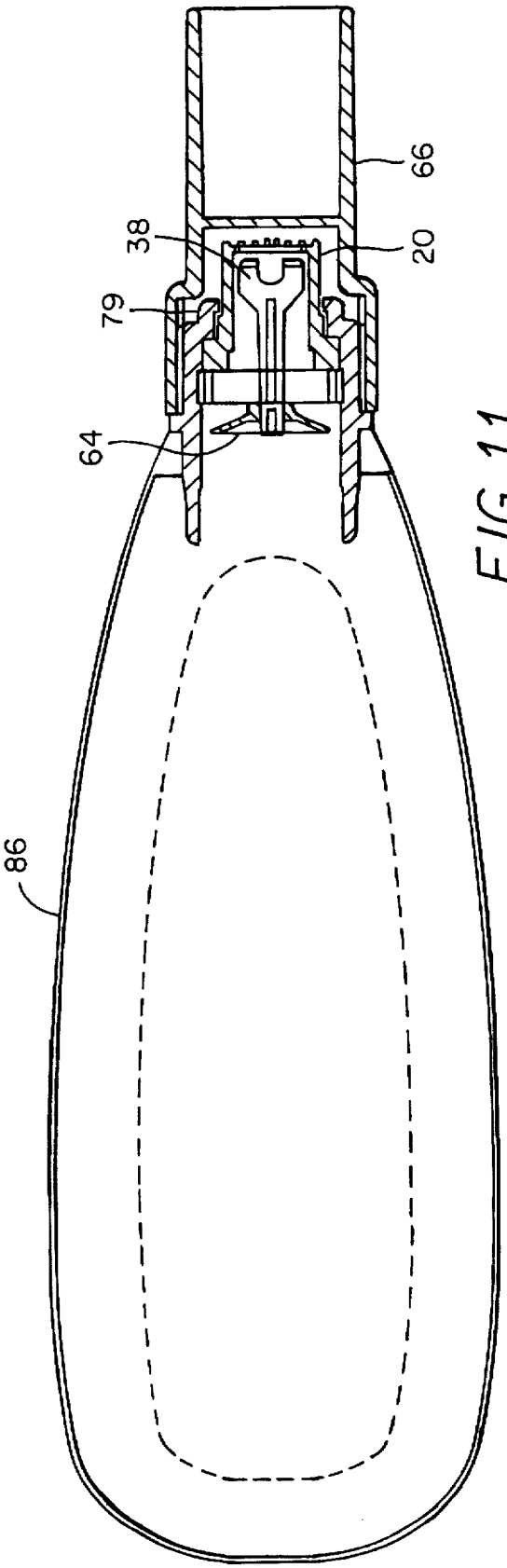
FIG. 11 is a second cross-sectional view of the first alternative embodiment shown in FIG. 10.

In a first alternative embodiment, the instrument may include a squeezable barrel or bottle 86 as shown in FIGS. 10–11. In a second alternative embodiment, the instrument may contain a follower 88 within the fluid reservoir to diminish the capacity of the fluid reservoir as shown in FIG. 12. During use of the instrument, the follower advances towards the nib in proportion to the amount of fluid dispensed, thus obviating the need for air to be drawn into the fluid reservoir to replace the fluid dispensed therefrom. The follower 88 may move forward due to the vacuum or a biasing means 90, such as a spring, may act upon the follower 88.

Figure 13:
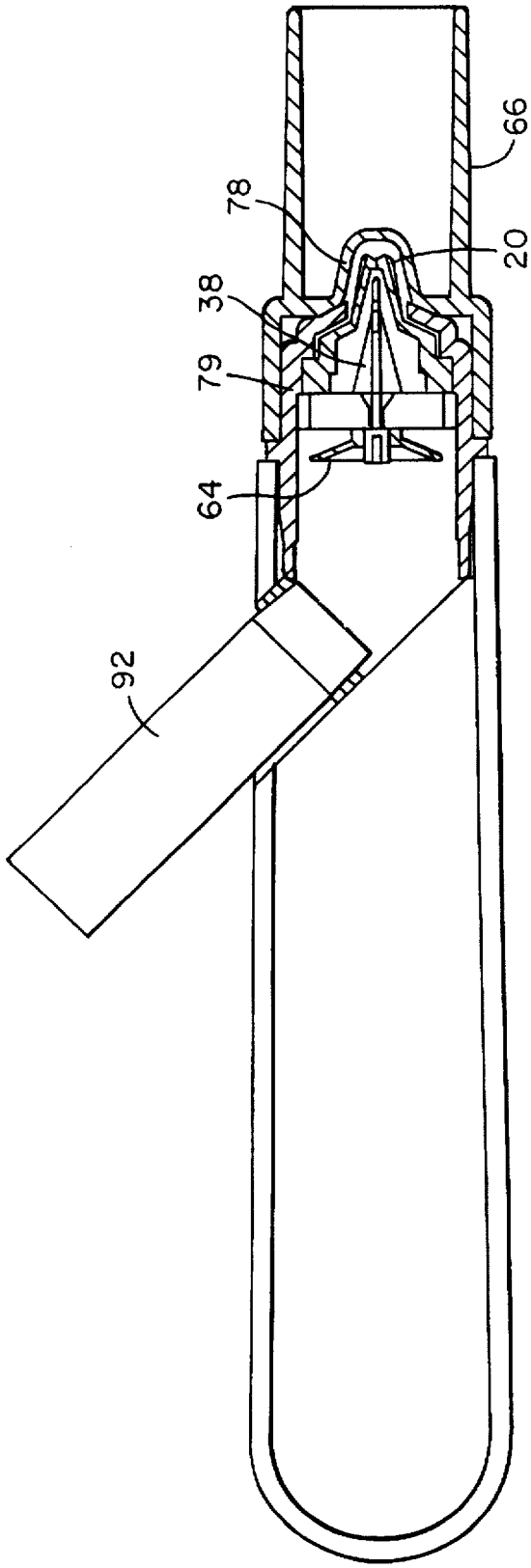
FIG. 13 is a cross-sectional view of a third alternative embodiment using a cartridge reservoir.
Figure 14:
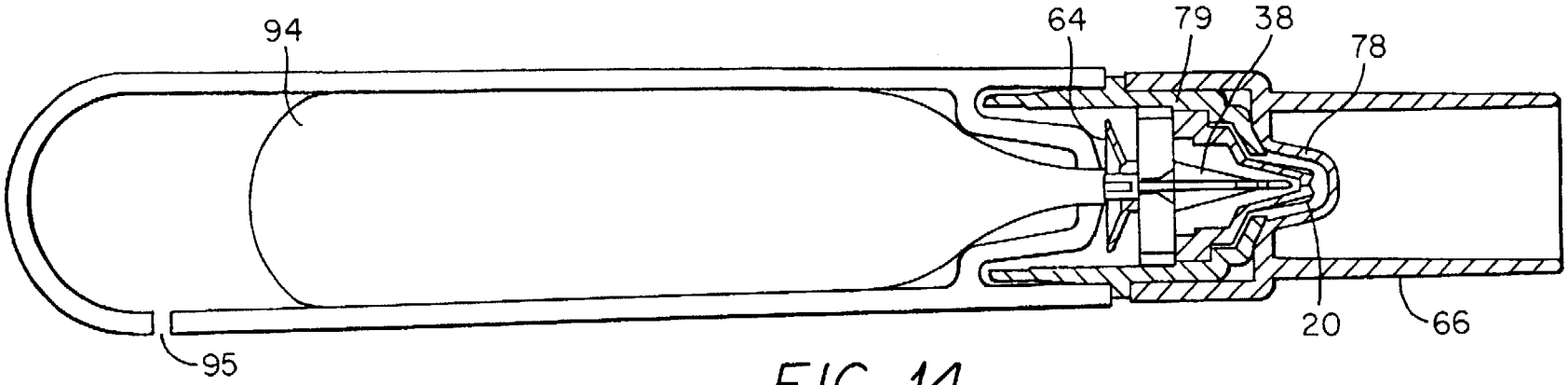
FIG. 14 is a cross-sectional view of a fourth alternative embodiment using a bladder reservoir.
Figure 15:
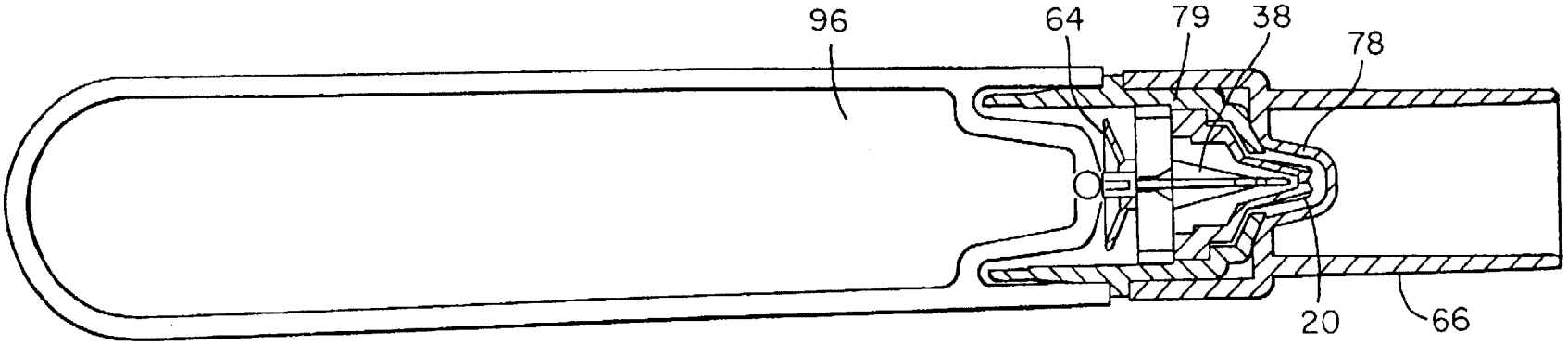
FIG. 15 is a cross-sectional view of a fifth alternative embodiment using a pressurized reservoir.

In a third alternative embodiment, the instrument may include a replaceable cartridge 92 as shown in FIG. 13. In a fourth alternative embodiment, the fluid reservoir may be comprised of a bladder 94 that will collapse as fluid is dispensed as shown in FIG. 14. The barrel may contain a vent hole 95 to permit air to enter the barrel as the bladder 94 reduces in size. In a fifth alternative embodiment, the instrument may include a pressurized reservoir 96 as shown in FIG. 15.

An instrument according to the present invention may contain a variety of fluids, such as coloring fluids, glues, oils, solvents, and the like. With regard to coloring fluids, any type of such fluids may be included, such as paint, ink, and so forth. The nib and instrument are capable of accommodating fluids having a viscosity up to about 100 centipoise. In addition, the fluid may contain particulate matter. The particulate matter may be the following materials and particle size:

| Material | Particulate Size |
|---|---|
| Metallics | 2–150 microns |
| Phosphorescent | 5–25 microns |
| Textures (e.g. sand) | 45–100 microns |
| Glitter | 20–200 microns |
| Pigments | 5–50 microns |

The instrument is designed to deposit fluid onto a substrate, such as surface 56 in FIG. 4. The substrate may be a marking substrate or surface. No limitation is contemplated for the substrates for which an instrument according to the present invention is useful. For example, the instrument may be used to deposit fluid on paper, wood, metal, plastic, glass, stone, and so forth.

A method of making a mark on a piece of paper or other substrate also falls within the preview of the present invention. In general, the method comprises utilizing a nib or the instrument according to the present invention. The method may be used to dispense a wide variety of fluids, including fluids containing particulate matter, such as glitter.

The present invention thus overcomes the drawbacks noted above. A nib according to the present invention will remain closed until used, and will not allow fluid to be inadvertently dispensed. The nib is capable of dispensing fluids having a wide range of viscosities and other fluid properties, and will accommodate fluids containing particulate matter. In addition, the nib will not allow accumulation of dried fluid.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references cited herein are hereby incorporated by reference in their entireties.

What is claimed is:

1. A nib for dispensing a fluid said nib comprising:

an elastomeric valve, said valve comprising a first wall terminating at a sealing lip and a second wall terminating at a second sealing lip, wherein said first and second sealing lips define a fluid dispensing slit; and an internal resistor disposed within said valve, wherein said internal resistor is relatively rigid with respect to said first and second walls, said internal resistor is spaced apart from said first and second walls and depends in a direction generally towards said fluid dispensing slit;

whereby, when said nib is drawn across a surface in a direction substantially transverse to said fluid dispensing slit such that said second sealing lip trails said first sealing lip, said first wall abuts said internal resistor to thereby separate said second sealing lip from said first sealing lip and to thereby open said fluid dispensing slit.

2. A nib according to claim 1, wherein said value is a duckbill valve.

3. A nib according to claim 1, wherein said first sealing lip terminates at a first bottom edge, wherein said second sealing lip terminates at a second bottom edge, wherein said fluid dispensing slit is formed by said first and second edges.

4. A nib according to claim 1, said nib having an exterior surface, wherein said exterior surface includes a first opposing face and a second opposing face, wherein said nib includes a first external resistor associated with said first opposing face, wherein said nib includes a second external resistor associated with said second opposing face, wherein each of said resistors is relatively rigid with respect to said valve;

and said nib has a proximal end and a distal end, wherein said distal end includes a major surface, wherein said major surface includes at least one protrusion extending from said major surface.

5. A nib according to claim 1, wherein said nib has an exterior surface, wherein said nib includes an external resistor on said exterior surface, wherein said external resistor is relatively rigid with respect to said valve.

6. A nib according to claim 5, wherein said external resistor is attached to said exterior surface.

7. A nib according to claim 5, wherein said external resistor is integral with said exterior surface.

8. A nib according to claim 5, wherein said exterior surface includes a first opposing face and a second opposing face, wherein said nib includes a first external resistor on said first opposing face, wherein said nib includes a second external resistor on said second opposing face, wherein each of said resistors is relatively rigid with respect to said valve.

9. A nib according to claim 8, wherein said external resistor is attached to said exterior surface.

10. A nib according to claim 8, wherein said external resistor integral with said exterior surface.

11. A nib according to claim 1, wherein said nib has a proximal end and a distal end, wherein said distal end includes a major surface, wherein said major surface includes at least one protrusion extending from said major surface.

12. A nib according to claim 11, wherein said major surface includes a plurality of protrusions, wherein said protrusions form at least one channel.

13. A nib according to claim 1, wherein said internal resistor substantially retains the shape of said nib when said valve is drawn across a surface.

14. The invention as in claim 13 wherein said internal resistor prevents said first sealing lip from collapsing.

15. The invention as in claim 13 wherein said nib has a first exterior surface and a second exterior surface, a first external resistor associated with said first exterior surface, a second external resistor associated with said second exterior surface, said first and second external resistors are relatively rigid with respect to said walls.

16. The invention as in claim 13 wherein said nib has a proximal end and a distal end, said distal end includes a major surface having a plurality of protrusions extending therefrom, said protrusions defining a plurality of channels extending transversely across said major surface.

17. An instrument for dispensing a fluid, said instrument comprising:

a barrel;

a fluid reservoir disposed within said barrel; and a nib fluidly connected to said fluid reservoir, said nib comprising:

an elastomeric valve, said valve comprising a first wall terminating at a first sealing lip and a second wall terminating at a second sealing lip, wherein said first and second sealing lips define a fluid dispensing slit; and an internal resistor disposed within said valve, wherein said internal resistor is relatively rigid with respect to said first and second walls, said internal resistor is spaced apart from said first and second sealing walls and depends in a direction generally towards said fluid dispensing slit;

whereby, when said nib is drawn across a surface in a direction substantially transverse to said fluid dispensing slit such that said second sealing lip trails said first sealing lip, said first wall abuts said internal resistor to thereby separate said second sealing lip from said first sealing lip and to thereby open said fluid dispensing slit.

18. An instrument according to claim 17, wherein said reservoir contains a fluid.

19. An instrument according to claim 18, wherein said fluid contains particulate matter.

20. An instrument according to claim 19, wherein said particulate matter is selected from the group consisting of metallics, phosphorescent, textures, glitter and pigments.

21. An instrument according to claim 18, wherein said instrument is a marking instrument.

22. A marking instrument according to claim 21 wherein said fluid is a coloring composition.

23. A marking instrument according to claim 22 wherein said fluid contains particulate matter.

24. A marking instrument according to claim 23 wherein said particulate matter is selected from the group consisting of metallics, phosphorescent, textures, glitter and pigments.

25. An instrument according to claim 17, further including a cap removably attachable to said barrel so as to cover said nib.

26. An instrument according to claim 25, wherein said cap includes an inner portion to conformingly engage said nib.

27. An instrument according to claim 17, wherein a collar secures said nib to said barrel.

28. An instrument according to claim 17, further including a hydraulic dampener between said nib and said barrel.

29. An instrument according to claim 28, wherein said hydraulic dampener is constructed of a flexible material.

30. An instrument according to claim 28, wherein said dampener seals said fluid reservoir when said instrument is dropped.

31. A method of making a mark on a substrate, said method comprising:

grasping a marking instrument, said marking instrument comprising a barrel; a fluid reservoir disposed within said barrel; and a nib fluidly connected to said fluid reservoir; said fluid reservoir containing a fluid, and said nib comprising a valve, said valve comprising a first wall terminating at a first sealing lip and a second wall terminating at a second sealing lip, wherein said first and second sealing lips define a fluid dispensing slit; an internal resistor disposed within said valve, wherein said internal resistor is relatively rigid with respect to said first and second walls; and drawing said nib across a substrate in a direction substantially transverse to said fluid dispensing slit such that said second sealing lip trails said first sealing lip and causing said first sealing lip to separate from said second sealing lip, thus allowing said valve to open to dispense a portion of said fluid.

32. A method according to claim 31, wherein said fluid contains particulate matter.

33. A method according to claim 32, wherein said particulate matter is selected from the group consisting of metallics, phosphorescent, textures, glitter and pigments.

* * * * *

UNITED STATES PATENT AND TRADEMARK OFFICE

CERTIFICATE OF CORRECTION

PATENT NO. : 5,727,893
DATED : March 17, 1998
INVENTOR(S) : Michael D. Handler

It is certified that error appears in the above-identified patent and that said Letters Patent is hereby corrected as shown below:

Column 4, lines 64 and 65. Line 65 should not begin a new paragraph, it should continue with previous paragraph.

Column 5, lines 18 and 19. Line 19 should not begin a new paragraph, it should continue with previous paragraph.

Signed and Sealed this

Second Day of June, 1998

*Attest:*

Bruce Lehman

BRUCE LEHMAN

*Attesting Officer*

*Commissioner of Patents and Trademarks*